US007114451B2

(12) United States Patent
Albrich et al.

(10) Patent No.: US 7,114,451 B2
(45) Date of Patent: Oct. 3, 2006

(54) APPARATUS FOR MONITORING THE LOCKING OF THE SAFETY BAR OF A CHAIR IN A CABLEWAY SYSTEM

(75) Inventors: Reinhard Albrich, Dornbirn (AT); Christoph Hinteregger, Wolfurt (AT)

(73) Assignee: Innova Patent GmbH, Wolfurt (AT)

( * ) Notice: Subject to any disclaimer, the term of this patent is extended or adjusted under 35 U.S.C. 154(b) by 419 days.

(21) Appl. No.: 10/439,736

(22) Filed: May 16, 2003

(65) Prior Publication Data

US 2004/0003751 A1 Jan. 8, 2004

(30) Foreign Application Priority Data

Jul. 4, 2002 (AT) ..... A 999/2002

(51) Int. Cl.
*B61B 7/00* (2006.01)

(52) U.S. Cl. ..... 105/149.2; 105/148; 104/89; 104/173.1; 187/201

(58) Field of Classification Search ..... 105/149.2, 105/148; 104/89, 112, 179, 178, 173.1, 173.2, 104/90, 28, 27; 280/806, 801
See application file for complete search history.

(56) References Cited

U.S. PATENT DOCUMENTS

| | | | | |
|---|---|---|---|---|
| 4,003,314 | A * | 1/1977 | Pearson | 104/307 |
| 5,533,594 | A * | 7/1996 | Tremblay et al. | 187/201 |
| 5,939,795 | A * | 8/1999 | Yu | 307/10.1 |
| 6,494,145 | B1 * | 12/2002 | Kernan | 105/149.1 |
| 6,520,573 | B1 * | 2/2003 | Osterle | 297/184.11 |
| 6,691,624 | B1 * | 2/2004 | Albrich | 105/149.2 |

* cited by examiner

*Primary Examiner*—Frantz F. Jules
(74) *Attorney, Agent, or Firm*—Laurence A. Greenberg; Werner H. Stemer; Ralph E. Locher

(57) ABSTRACT

An apparatus monitors the locking of the safety bar of the chairs of an aerial cableway system. A first sensor determines the occupancy of the chairs and a second sensor determines the locking of the safety bar. The sensor output signals from these two sensors are led to a control device, which is enabled to switch the chairlift system off.

6 Claims, 1 Drawing Sheet

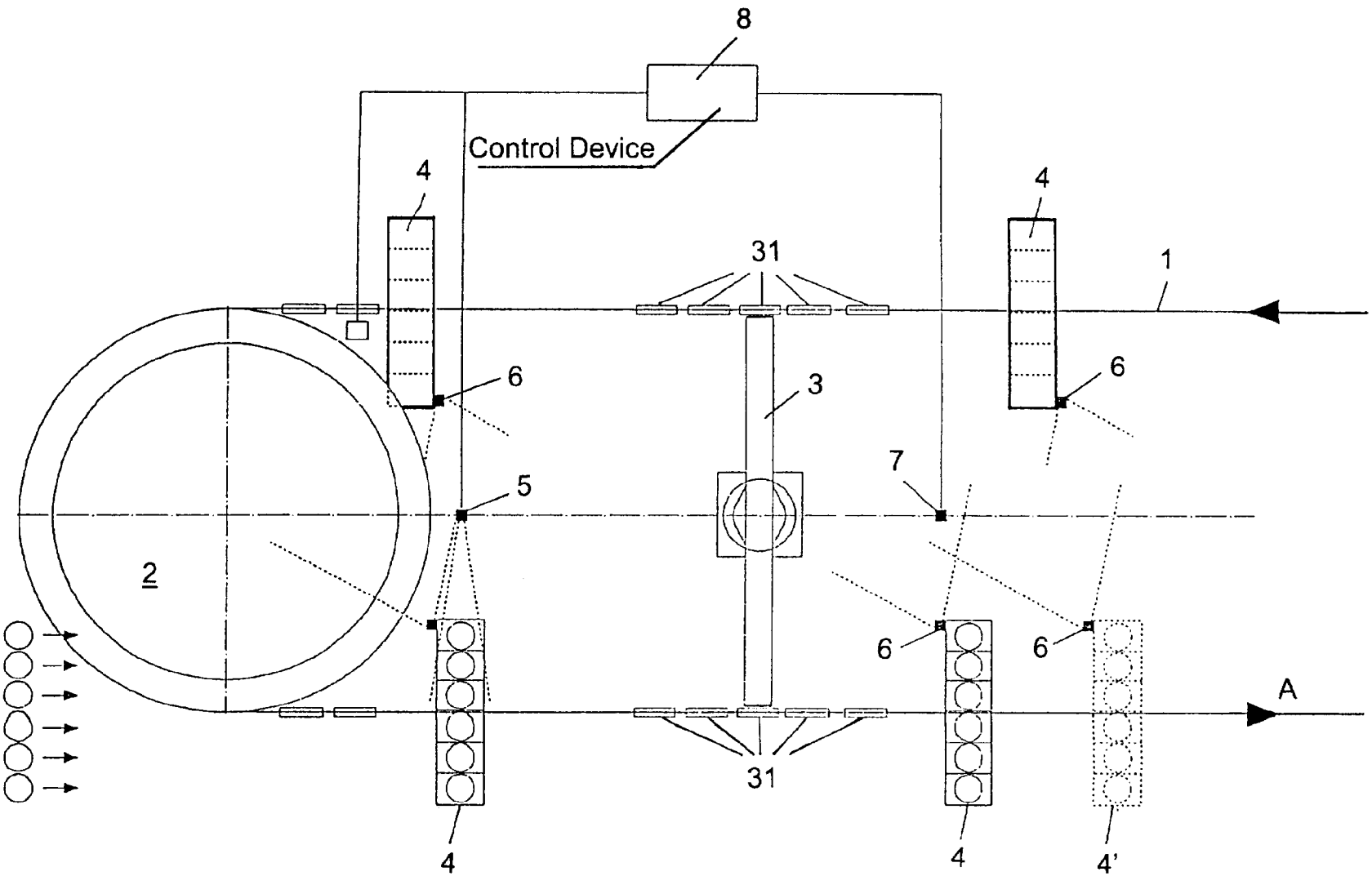
A
1
6
4
4'
6
4
7
6
3
31
31
8
Control Device
6
5
4
4
2

APPARATUS FOR MONITORING THE LOCKING OF THE SAFETY BAR OF A CHAIR IN A CABLEWAY SYSTEM

BACKGROUND OF THE INVENTION

Field of the Invention

The present invention lies in the field of aerial cableway and chairlift systems. More specifically, the invention relates to an apparatus for monitoring the locking of the safety bar for chairs in a chairlift system.

It is known to construct the chairs of a cableway system with a device for locking the respective safety bar. A locking device of this type is required in order to be able to rule out the possibility of the safety bar being opened during the journey to the mountain station or to the valley station, as a result of which the persons on the chair could fall out. This risk exists, in particular, in the case of children.

SUMMARY OF THE INVENTION

It is accordingly an object of the invention to provide a monitoring apparatus which overcomes the above-mentioned disadvantages of the heretofore-known devices and methods of this general type and which provides an apparatus by means of which, as a chair travels out of a station, a check is made to establish whether the safety bar of the chair is locked in the closed position in accordance with the requirements. If the safety bar is not properly locked, the cable railroad system may be stopped.

With the foregoing and other objects in view there is provided, in accordance with the invention, an apparatus for monitoring the locking of the safety bar of a chair in a cableway system, which comprises:

a first sensor disposed to determine whether or not a given chair is occupied and outputting a corresponding first sensor signal;

a second sensor disposed to determine whether or not the safety bar of the given chair is locked and outputting a corresponding second sensor signal; and a control device disposed to receive the first and second sensor signals, and for outputting a corresponding control signal (for example, to cause the system to temporarily shut down, until the safety bar can be locked into its safe position).

In other words, the objects are achieved by a first sensor being provided, by means of which the occupancy of the chairs can be determined, and by a second sensor being provided, by means of which the locking of the safety bar can be determined, the output signals from the two sensors being led to a control device, by means of which the cable railroad system can be switched off.

The first sensor is preferably arranged in a fixed position, responding as the chairs travel past. Furthermore, the second sensor is preferably arranged on the chair, and a transmitter which is assigned a fixed receiver and arranged on the chair is connected to this sensor.

Other features which are considered as characteristic for the invention are set forth in the appended claims.

Although the invention is illustrated and described herein as embodied in a apparatus for monitoring the locking of the safety bar of the chairs of a cableway system (also referred to as an aerial railroad system, a ropeway system, etc.), it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The figure is a schematic plan view of a valley station of a chairlift system having an apparatus for monitoring the locking of the safety bar according to the invention.

DESCRIPTION OF THE PREFERRED EMBODIMENTS

Referring now to the sole figure of the drawing in detail, the arial railway system illustrated therein has a load-bearing and conveying cable 1 which, in the valley station, is guided over a deflection pulley 2. At a distance from the deflection pulley 2 there is provided a support 3, on which load-bearing rollers 31 are disposed. The load-bearing and conveying cable 1 is guided along the rollers 31. Chairs 4 for a number of persons are coupled to the load-bearing and conveying cable 1 at a given spacing distance from one another.

Following the entry point, in the direction of travel A, there is provided a first sensor 5, which determines whether the relevant chair 4 is occupied by at least one person. If this is so, there is triggered a requirement that its safety bar must be pivoted into the closed position and locked in this position. Furthermore, the chairs 4 are provided with a second sensor 6, by means of which, as soon as the safety bar is closed and locked in its closed position, a signal is output to a fixed receiver 7 via a transmitter. The output signals from the first sensor 5 and the receiver 7 are applied to a control device 8.

If the occupancy of the relevant chair 4 is determined by the first sensor 5, and the locking of the safety bar is reported to the receiver 7 via the transmitter by the second sensor 6, no control signal is output by the control device 8. However, if the chair 4 is occupied and a signal passes from the first sensor 6 to the receiver 7 to the effect that the safety bar of the relevant chair 4 is not locked, the cable railroad system is switched off by the control device 8, or in response to the appropriate signal from the control device 8, as a result of which the relevant chair 4 comes to a stop after a short further travel.

This position is represented by the chair 4'. Once the safety bar has been locked, the cable railroad system may be started up again.

Since the chairs 4 are first occupied by the persons and only then are the safety bars pivoted into their closed position and locked in the latter, a sensing roller is used to carry out a distance measurement of the relevant chair 4 from the entry point as far as a location at which the safety bar of the relevant chair must already be locked. Since, in addition, the system has to be started up again when the safety bar has been locked after the system has been brought to a standstill, the receiver 7 must also be capable of receiving those signals which are output by a chair 4' after the system has been stopped.

The sensors used for the operation of the system can act on the basis of infrared, ultrasound, laser, radio, induction, wire-free transmission or the like. The critical factors are that the occupancy of the relevant chair is indicated by a first sensor and the locking of the safety bar is indicated by a second sensor, and that the signals in this regard are led to a control device, by means of which these signals are evaluated. In this case, the sensors can be arranged on the chair itself or fixed in the region of the station.

An apparatus of this type therefore ensures that the safety bars of occupied chairs of the cable railroad system are always locked during the journey between stations.

We claim:

1. An apparatus for monitoring the locking of the safety bar of a chair in a cableway system, which comprises:

a first sensor disposed to determine whether or not a given chair is occupied and outputting a corresponding first sensor signal;

a second sensor disposed to determine whether or not the safety bar of the given chair is locked and outputting a corresponding second sensor signal;

a control device disposed to receive the first and second sensor signals, said control device being configured to output a corresponding control signal only if the first sensor signal indicates that the given chair is occupied and the second sensor signal indicates that the safety bar of the given chair is not locked.

2. The apparatus according to claim 1, wherein said control device is configured to output a control signal causing the cableway system to temporarily shut down.

3. The apparatus according to claim 1, wherein said first sensor is disposed in a fixed position and responds as chairs of the cableway system travel past said first sensor.

4. The apparatus according to claim 1, wherein said second sensor comprises a transmitter disposed on the chair and a stationary receiver configured to receive a signal from said transmitter and to output the second sensor signal to said control unit.

5. In a cableway system having a plurality of chairs supported on and conveyed along a load-bearing and conveying cable and each provided with a safety bar for protecting persons occupying the respective chair, a safety monitoring method, comprising:

determining with a first sensor whether or not a given chair is occupied and outputting a corresponding first sensor signal;

determining with a second sensor whether or not the safety bar of the given chair is locked and outputting a corresponding second sensor signal;

receiving the first and second signals with a control device and, if the first sensor signal indicates that the given chair is occupied and the second sensor signal indicates that the safety bar of the given chair is not locked, outputting a corresponding control signal with the control device.

6. The method according to claim 5, which comprises issuing the control signal to temporarily shut down the cableway system.

* * * * *